United States Patent [19]

Roffelsen

[11] Patent Number: 4,655,282

[45] Date of Patent: Apr. 7, 1987

[54] HEAT EXCHANGER DUCT WITH HEAT EXCHANGE WIRING

[75] Inventor: Franciscus Roffelsen, Helmond, Netherlands

[73] Assignee: Spiro Research B. V., Helmond, Netherlands

[21] Appl. No.: 645,807

[22] Filed: Aug. 29, 1984

[30] Foreign Application Priority Data

Aug. 30, 1983 [DE] Fed. Rep. of Germany ..... 3331186

[51] Int. Cl.[4] ..... F28F 1/14

[52] U.S. Cl. ..... 165/184; 165/172; 165/910

[58] Field of Search ..... 165/172, 181, 182, DIG. 13, 165/184

[56] References Cited

U.S. PATENT DOCUMENTS

| | | | |
|---|---|---|---|
| 1,960,305 | 5/1934 | Emmons et al. | 165/184 |
| 2,268,680 | 1/1942 | Von Linde | 165/184 |
| 2,277,462 | 3/1942 | Spofford | 165/184 |
| 2,308,319 | 1/1943 | Stanton | 165/184 |
| 2,793,835 | 5/1957 | Woods | 165/172 |
| 3,217,392 | 11/1965 | Roffelsen | 165/184 |
| 3,592,262 | 7/1971 | Brucken | 165/184 |
| 3,643,735 | 2/1972 | Huggins | 165/172 |
| 3,740,527 | 6/1973 | Roffelsen | 165/184 |
| 3,856,079 | 12/1974 | Geppelt | 165/184 |

FOREIGN PATENT DOCUMENTS 1012864 7/1952 France .

*Primary Examiner*—Ronald C. Capossela
*Attorney, Agent, or Firm*—Toren, McGeady and Goldberg

[57] ABSTRACT

In order to create a space-saving, block-like heat exchanger duct bundle 14 from externally wired heat exchanger tubes without additional support structures, the heat exchanger ducts each consist of a core tube 3 having a coiled wire wrapping of wiring 16 extending over the entire length of the core tube (3), the turns of the coil are shaped so that the periphery of the wrapped coil has oppositely situated flat zones 13 to enable the ducts to be packed together. Preferably the peripheries of the wrapped coils are hexagonal in cross-section as shown so that the bundle forms a honeycomb structure.

5 Claims, 13 Drawing Figures

HEAT EXCHANGER DUCT WITH HEAT EXCHANGE WIRING

This invention relates to heat exchanger ducts comprising a core tube with heat exchange wiring fixed to its external surface along the length of the core tube.

Such ducts are known, for example, as heating ducts for use in a low temperature space heating system made by SPIRO Research B.V. and known as "Spirotherm". A cylindrical core tube forms a support for a coil of copper wire the axis of which is wrapped helically around the tube and the turns of which are soldered to the surface of the core tube to form a unit and has, as viewed in cross-section of the core tube, a circular peripheral shape. The effective surface, i.e. the surface which emits heat to the surroundings, is many times larger than with conventional heat exchangers forming radiators. The requirement for water, conducted through the core tubes, is only very low, with the consequence that the heating system responds rapidly. Even where only small differences exist between the temperature of the heating unit and that of the surrounding air, the air is set in motion between the turns of the copper wire coils. The heated-up air ascends and is replaced by air flowing in, which then in turn is heated by the wire coils. An air circuit is thus set up and, since large quantities of air are heated up on each occasion, good heating results are obtained even where the temperature of the airstreams is not very much higher than the desired room temperature. A water temperature of 50° C., related to winter operation, is sufficient for heating, and this means that the heating system can be operated in conjunction with solar cells or heat pumps. The aforementioned results have been confirmed by experiments.

From a plurality of ducts wired in this manner, heat exchanger bundles having excellent properties can be manufactured, the tubes, with the copper wire coils having circular peripheries being disposed either in straight lines or in staggered rows. In the first case, the longitudinal axes of the tubes are always disposed above one another while in the other case the longitudinal axes of each lower row of tubes is staggered relative to the adjacent upper row by one-half the diameter of the duct and thus lie partially in the gap formed between two ducts. By this staggered arrangement, a saving in space of approximately 13.5% is obtained. A reduction in the space demand beyond this amount is not possible, however, with the known heat exchanger ducts.

Furthermore, with ducts having a circular wiring cross-sectional peripheral shape, the ducts which are assembled to form a heat exchanger bundle touch one another basically only at points or lines extending through the common tangents of adjacent helically wrapped coils. For this reason little mutual support can be obtained. In operation, this frequently leads to an unpleasant singing or whistling tone, produced by air or other media flowing transversely through the heat exchanger bundle. Furthermore, from a specific length of ducting and with a limited speed of flow of the medium to be heated or cooled through the bundle of ducts the heating ducts start to vibrate with an increasingly higher frequency of the tone. The pipes then deform and press into one another at their contact points, so that free openings occur between adjacent ducts and this permits even more pronounced vibration, which rapidly produces cold deforming and fatigue and as a consequence tends to lead to breakage of the core tube. In order to eliminate this risk, the bundled heating ducts have to be supported by transverse walls at relatively close intervals, but this makes the construction more complicated and also increases costs.

The object of the present invention is to avoid the aforementioned disadvantages and still further reduce the space required for a bundle of heat exchanger ducts as initially described with small constructional costs.

To this end, according to this invention, a heat exchanger duct as initially described is provided wherein the wiring is formed so that its periphery as seen in cross-section of the core tube has at least two flat zones lying opposite each other on opposite sides of the core tube.

In one preferred example, the periphery of the wiring as seen in cross-section of the core tube is hexagonal so that there are three pairs of opposite flat zones.

According to a further feature of the invention double wiring may also be provided. This consists of inner wiring of circular peripheral cross-sectional shape and outer wiring which is the wiring of hexagonal peripheral shape. With this arrangement, a bundle of the ducts may be assembled to form a honeycomb structure.

The duct in accordance with the invention thus departs from the hitherto usual circular cross-sectional profile of the wiring and achieves, by the provision of the flat zones, mutually supporting and bracing bearing surfaces for adjacent ducts in a bundle. In this way additional stiffenings and supports are rendered unnecessary. In particular with a honeycomb arrangement of the hexagonally profiled heating ducts to form a heat exchanger bundle, a further saving in space of more than 20% is obtained, as compared with the staggered arrangement of externally circular ducts. In proportion to this percentage, the inner surface of the core tubes through which, for example, water flows can be increased, without the total volume or space demand thereby needing to be increased. Moreover, a thermodynamic advantage is obtained, because the heat can be exchanged through the flat zones of the wiring in contact with one another over large areas. This has the effect of producing a more uniform temperature distribution with a more uniform heat loading of the individual ducts of the heat exchanger bundle. Moreover, a limited mobility of the wiring in the axial direction of the tubes is assured, enabling expansion changes in length during heating and cooling to be accommodated without problems. Furthermore, the flat zones facilitate the construction of a consistent heat exchanger block which, by contrast with a lamellar block, has the great advantage that flow of the medium to be heated or cooled can take place through it turbulently in any direction.

The invention furthermore proposes that the core tube may be of flat cross-section with two opposite flat zones of the wiring parallel to the flat faces of the core tube. A blown air flow may then take place parallel and completely in transverse flow across all the wiring which is still preferably in the form of coils. The resistance to flow of the air is reduced to a minimum by the flat core tubes.

Embodiments of the invention provide that the heating duct with a circular or profiled core tube may be bent spirally in the manner of a clock spring or helically in the manner of a coiled tension spring. In particular if the heat exchanger duct is bent to a hairpin shape, the advantage is offered that an additional liquid header or water header is no longer necessary at the outlet side of a bundle of such ducts, opposite to a water or other liquid inlet, so that construction costs can be further reduced.

The flat zones of the profiled heating ducts make it possible, according to a further optional feature of this invention, for the zones which bear against one another in a heat exchanger bundle to be fixed together with a thermally conducting metal adhesive. Alternatively these zones can be brought together dry, that is without any intermediate layer, the assembly being then banded with bands to hold the ducts together. This may be done, for example, with tightened wrapping bands. The flat zones of the wiring, for example the wire coils possess a high resistance to surface pressure, so that the wrapping bands ensure the firm stiffening. Heat exchanger ducts, such as space heating ducts which are glued or banded together to form a rigid heat exchanger block, do not require any additional support frame for their installation and support.

The acceptance of bending forces and the avoidance of deformations may however be achieved by a frame encompassing the heat exchanger bundle and intermediate metal plates may be provided between mutually facing portions of the flat zones. Clamps fitted onto a U-frame have a satisfactory supporting action.

In the manufacture of a cylindrical core tube or a flat core tube having a wiring of hexagonal peripheral shape in cross-section with three pairs of opposite flat zones, which is carried out by a step-by-step rolling method, the turns in the helical wrapping of the wire coils are not pushed against one another but lie free. The pitch of the helical wrapping is so selected according to the bending radius of the axis of the coil that soldering at the foot of the helix, i.e. the connection between the turns of the coil and the tube, is not broken by crushing during bending, i.e. on the concave side of the wrapped coil. On the other side, i.e. the convex side of the wrapped coil, the same problem exists on account of the tensile loading, because stretching instead of compression occurs there, so that here again the stress is a function of the radius of wrappng of the coil around the core tube and provides a limit for the pitch.

Several examples of heat exchanger ducts in accordance with the invention will now be described with reference to the accompanying drawings in which.

Figure 1:
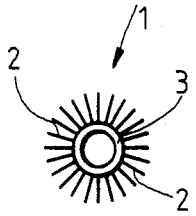
FIG. 1 is a cross-section of a known duct with wires fixed to a core tube so that the periphery of the wires as seen in cross-section is circular.
Figure 2:
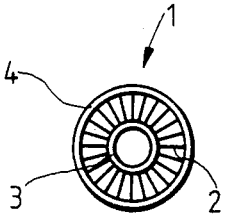
FIG. 2 is a cross-section showing a duct according to FIG. 1 seated in a cylindrical casing pipe.
Figure 3:
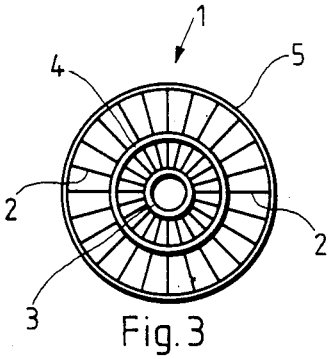
FIG. 3 is a cross-section showing the duct according to FIG. 2 with a further external wire coil wrapping and a stiffening wire wrapped around the external wire coil.

In FIGS. 1 to 3, known heat exchanger ducts referenced generally 1 and having wires fixed around them so that the periphery of the wires is circular in cross-section are illustrated in various phases of construction. According to FIG. 1, the wiring consists of individual wires 2, which are soldered externally onto the cylindrical core tube 3 an may be laid in the form of a coil, the turns of which form the individual wires with the axis of the coil wrapped helically around the pipe. Where the term "wires" is used hereinafter, it is understood to include especially a wire coil the turns of which form the individual wires. Copper is especially suitable as material for the wires, on account of its good thermal conductivity. According to FIG. 2, a casing pipe 4 encases the wired core tube 3 and according to FIG. 3 further wires are again soldered onto the casing pipe 4, these wires being connected together at their outer ends by a head wire 5 and thus being stiffened. The wires 2 may also be attached by passing them through the casing pipe 4 and soldering them at the passages. The construction according to FIG. 3 can be regarded as a starting concept for a double wired duct made in accordance with this invention, as illustrated in FIG. 4.

Figure 4:
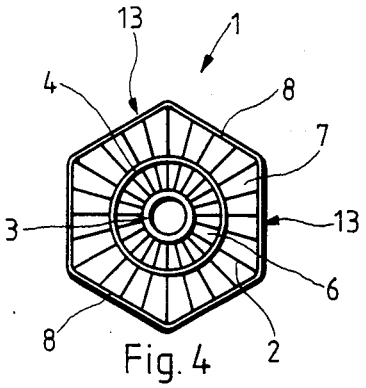
FIG. 4 is a cross-section corresponding to FIG. 3, but showing the external wiring formed so that its periphery is hexagonal and is in accordance with the present invention.

The heating duct 1 which is hexagonally profiled in cross-section as shown in FIG. 4 has inner circular wiring 6, which like the duct shown in FIG. 2 is composed of wires soldered between the casing pipe 4 and the core tube 3. Externally, there is wiring 7 of hexagonal peripheral shape in cross-section with flat zones 13, stiffened at the periphery by a head wire 8. The wires here again can be made in one piece as a coil or as a number of axially extending zig-zag wires soldered in passages through the casing pipe 4. It is also possible to push a casing pipe having the desired profile over the wire ends. In the example of FIG. 4 the casing pipe would have to be a hexagonal pipe, and which extends over the entire length of the core tube.

Figure 5:
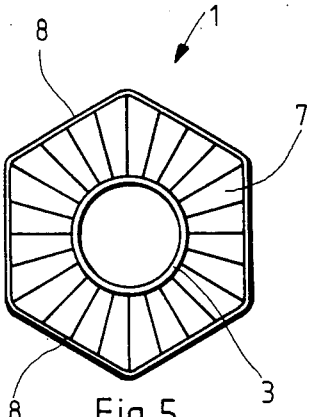
FIG. 5 is a cross-section of another duct in accordance with the invention.
Figure 6:
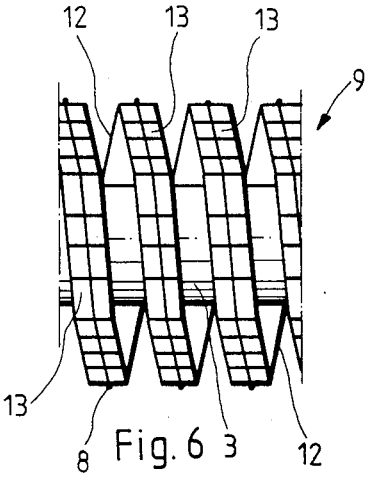
FIG. 6 is a side view of the example of FIG. 5.
Figure 7:
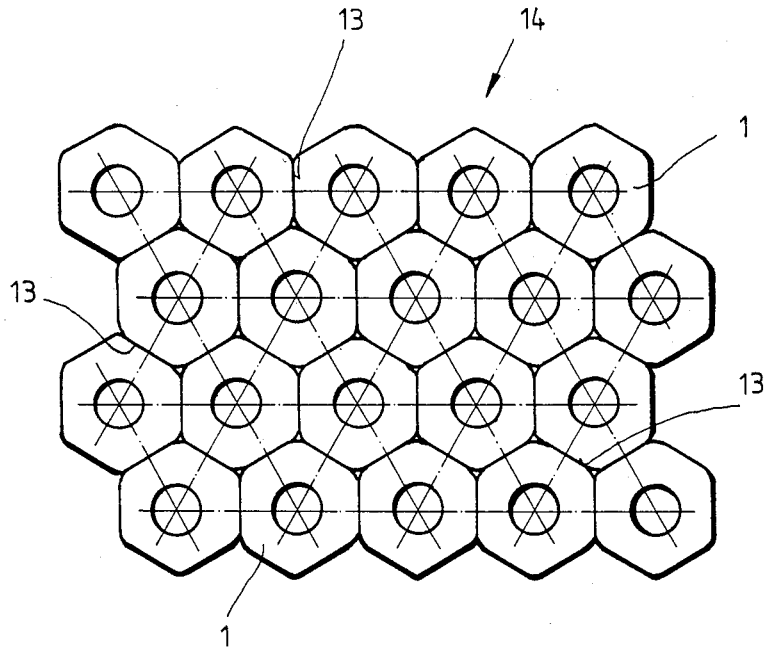
FIG. 7 is a cross-section through a bundle of ducts each in accordance with FIGS. 5 and 6.

FIG. 5 shows a heating duct 1, in which the hexagonally profiled wiring 7 has been soldered directly onto a cylindrical core tube 3 without any intermediate casing pipe. A wire coil 9 is wrapped with flattened helical turns 12 (FIG. 6). In the construction having open helical turns 12, the core tube can be easily bent. The helical turns 12 can, of course, also be pushed up against one another so that the flat zones 13 of the helical turns 12 constitute a continuous flat area, as is also the case with a pushed-on, profiled casing tube. A plurality of the heating ducts 1 having a hexagonal cross-section constitute, according to FIG. 7, a heat exchanger bundle 14, which can be assembled space-savingly in a honeycomb form, the flat zones 13 of the individual heating ducts 1 providing mutual support and bearing surfaces.

Figure 8:
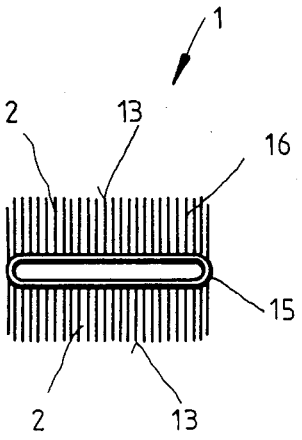
FIG. 8 is a cross-section through another example of a duct in accordance with the invention having a core tube of flattened cross-section.
Figure 9:
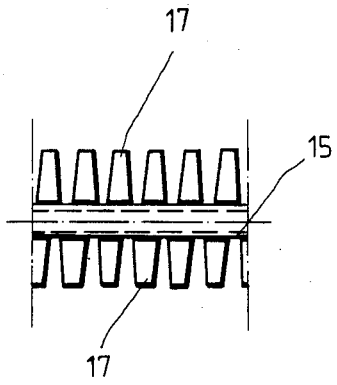
FIG. 9 is a side view of the example of FIG. 8.
Figure 13:
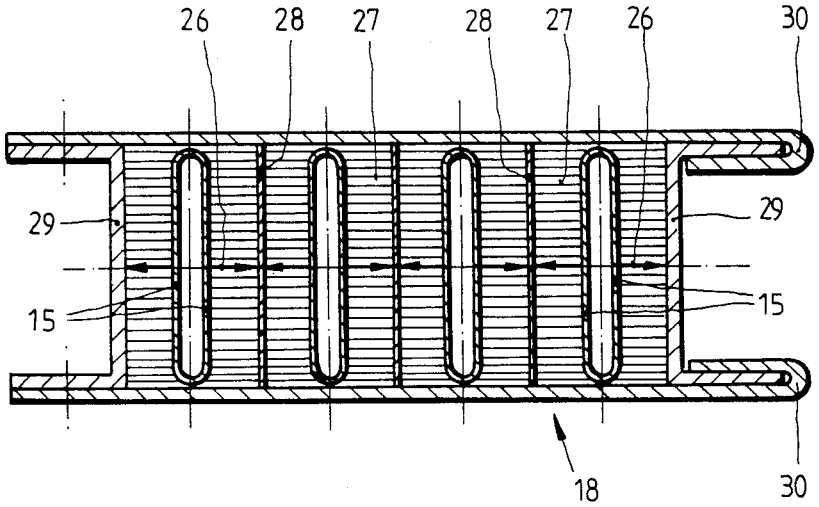
FIG. 13 is a cross-section along the line XII—XII of FIG. 12 through a heat exchanger duct according to FIG. 12, compressed to form a heating block.

In the example of FIG. 8, the heat exchanger duct 1 has a flattened core tube 15, which serves as a carrier element for soldered-on wires 2, which are constructed as a profiled wiring 16 in the form of a coil having trapezoidal turns 17 with resultant large upper and lower flat zones 13 (FIG. 9). A flat core tube 15 can be especially easily bent, for example to meandering or helical form, and be compressed to form a block, it being then especially easy to make multi-row heating blocks 18, for example according to FIG. 13 a four-row block, when the flat core tube 15 is bent to double hairpin or zig-zag form. The flat core tube 15 can then be further bent and compressed, until flat zones 13 situated on the same side of the flat core tube touch one another. In this position, the surfaces can be bonded to one another or the entire block can be banded with pulled-on encompassing bands. The bending forces, indicated by arrows 26, exerted on the walls of the flat core tube 15 of the heating block 18 can, according to FIG. 13, be transmitted via the wiring constituting wire loop packages 27 onto intermediate metal plates 28, inserted between mutually facing flat zones. Lateral expansion is then contained by a U-shaped frame 29 encompassing the heating block 18. Clamps 30 distributed at intervals along both sides of the frame 29 protect the frame 29 against outward bending. The strip-shaped clamps 30 are bent around at one end to form hooks for this purpose and engage, with the thus formed hooks, over a flange of the U-shaped frame 29. At the opposite end, bolts connect the clamps 30 to the frame 29 and secure the position of the flat core tube 15, which is compressed and tensioned to form the heating block 18. By the interposition of the metal sheets 28, the operating pressure is transmitted from one pipe layer to the next as far as the outer wall parts of the frame 29, encompassing the entire heating block 18.

Figure 10:
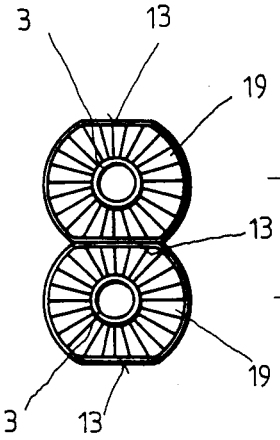
FIG. 10 is a cross-section of another example of a duct in accordance with the invention which is bent to a hairpin shape with an upper and a lower portion.
Figure 11:
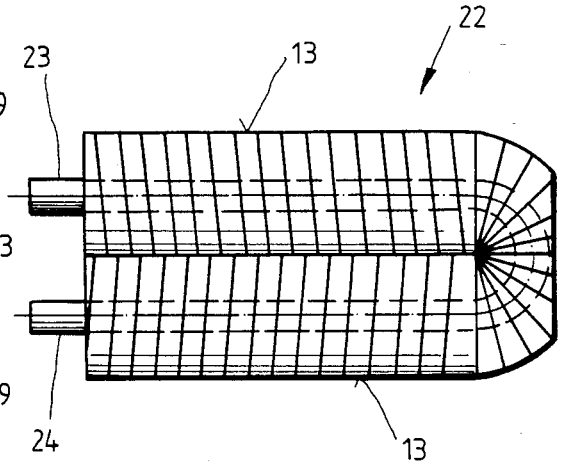
FIG. 11 is a side view of the example of FIG. 10.
Figure 12:
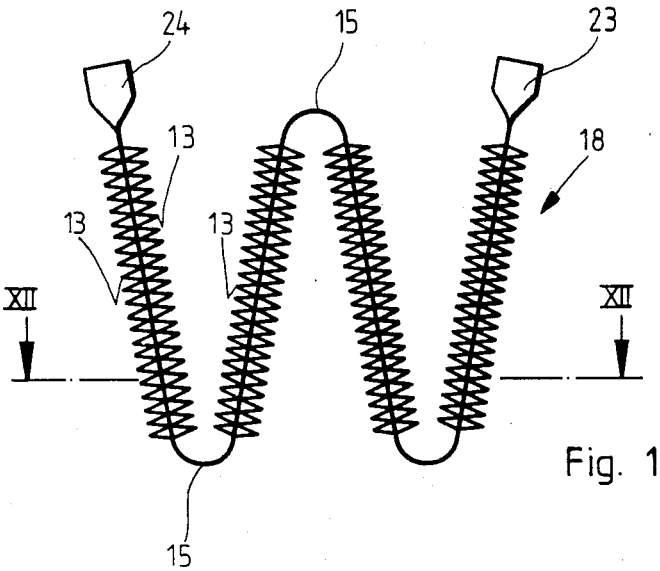
FIG. 12 is a side view of another example of a duct in accordance with the invention comprising a flat core tube bent to a double hairpin shape.

A hairpin form which creates mutually bearing flat zones 13 and thus leads to a closed block 22 (FIG. 11), can advantageously also be bent from a heating duct 1, as illustrating in FIGS. 10 and 11. In this example, a cylindrical core tube 3, is provided with a substantially cylindrical wiring profile 19, which has an upper and lower flattened zone of the cylinder, constituting the flat zones 13. Heating blocks 18, 22, bent to hairpin form, reduce the construction costs, since a fluid inlet 23 and fluid return 24 are disposed at one and the same side of the heating block 18 or 22 respectively. An additional water or other fluid header at the opposite side of the block is not necessary in this example.

I claim:

1. In a heat exchanger duct comprising an axially elongated core tube having an external surface and an internal surface, heat exchange wiring wound in helical turns around the external surface of said core tube and extendig for substantially the axial length of said core tube and means fixing said heat exchange wiring to said external surface of said core tube, the improvement wherein said heat exchange wiring is so formed that the periphery thereof as seen in cross-section of said core tube extending transversely of the axial direction thereof includes at least two flat zones extending generally circumferentially and lying opposite each other on opposite sides of said core tube with said flat zones located along the axial length of said core tube.

2. A heat exchanger duct as claimed in claim 1, in which said flat zones lie in parallel planes.

3. A heat exchanger duct as claimed in claim 1, in which said periphery of said wiring is of hexagonal shape as seen in cross-section of said core tubing, said hexagonal shape providing three pairs of said opposite flat zones.

4. A heat exchanger duct as claimed in claim 1 in which said wiring comprises a wire coil including turns, each of which is of trapezoidal shape and the axis of said coil being wrapped in a helix around said core tube.

5. A heat exchanger duct as claimed in claim 4, in which adjacent turns of said helix lie against one another axially on said core tube.

* * * * *